United States Patent [19]

Davies

[11] Patent Number: 4,850,630

[45] Date of Patent: Jul. 25, 1989

[54] CLAMP WITH MOVABLE JAW STRUCTURE

[75] Inventor: William Davies, Ponte Vedra Beach, Fla.

[73] Assignee: J.C. Renfroe & Sons, Inc., Jacksonville, Fla.

[21] Appl. No.: 18,739

[22] Filed: Feb. 24, 1987

Related U.S. Application Data

[63] Continuation-in-part of Ser. No. 818,757, Jan. 14, 1986, abandoned.

[51] Int. Cl.[4] ..... B66C 1/44

[52] U.S. Cl. ..... 294/103.1; 269/249; 269/258

[58] Field of Search ..... 294/103.1, 101, 104; 269/243, 249, 258, 261, 271, 279; 24/498, 587

[56] References Cited

U.S. PATENT DOCUMENTS

| | | | |
|---|---|---|---|
| 880,948 | 3/1908 | Wilhelm et al. . | |
| 895,647 | 8/1908 | Zang | 269/249 |
| 1,036,386 | 1/1912 | Denburg . | |
| 1,063,332 | 6/1913 | Diehl | 269/258 |
| 2,699,190 | 3/1952 | Packer . | |
| 2,729,126 | 2/1953 | Stanton, Jr. et al. . | |
| 2,845,828 | 12/1954 | Thomeczek . | |
| 3,120,046 | 2/1964 | Olsen | 24/498 |
| 3,178,219 | 4/1965 | Renfroe | 294/104 |
| 3,269,766 | 8/1966 | Gardner | 294/101 |
| 3,403,901 | 10/1968 | Servadio | 269/243 |
| 3,947,011 | 3/1976 | Tsuyama | 269/249 |
| 4,034,971 | 7/1977 | Tsuyama | 269/249 |
| 4,183,571 | 1/1980 | Renfroe | 294/101 |

FOREIGN PATENT DOCUMENTS

| | | |
|---|---|---|
| 841587 | 5/1939 | France . |

*Primary Examiner*—James B. Marbert

*Attorney, Agent, or Firm*—Banner, Birch, McKie & Beckett

[57] ABSTRACT

A screw-type clamp for gripping structural members such as steel sheets has the general form of a U-shaped clamp body, a screw threadedly received through a portion of the body and a jaw pivotally mounted to the body opposing the screw such that members may be securely gripped by a gripping surface on the screw and a gripping surface of the jaw. The jaw is mounted with a ball and socket configuration such that the gripping surface on the jaw stays parallel with the surface of the member being gripped. In a second embodiment, a similar jaw is mounted to the screw. The ball in the ball and socket joints contains an annular groove and is held into the socket by a plurality of pins that tangentially engage the annular groove.

40 Claims, 6 Drawing Sheets

CLAMP WITH MOVABLE JAW STRUCTURE

This application is a continuation-in-part of application Ser. No. 818,757, filed Jan. 14, 1986, and now abandoned.

BACKGROUND OF THE INVENTION

This invention relates to a screw-type clamp suitable for gripping structural members such as metal plates, beams, angles and the like in order, for example, to lift such members and to hold them in place for assembly into a structure.

The prior art contains numerous types of clamps suitable for gripping metal plates and the like. The majority of these prior art clamps incorporate one generally fixed jaw and another movable jaw which is somehow brought into contact with the material to be lifted. Some of the prior art devices, known as screw clamps, have incorporated a threaded shaft for advancing one jaw into engagement with the member to be clamped. Examples of such devices are disclosed in U.S. Pat. No. 4,183,571 and certain prior art identified therein. When a structural member is lifted by a screw clamp, the member may swing about and be twisted within the slot in which it is secured, thereby applying a torque to the screw shaft. Care must be exercised to maintain a secure grip during such twisting. While the device shown in U.S. Pat. No. 4,183,571 represents a substantial improvement in providing secure gripping action, the present invention adds another dimension resulting in further improvement for certain applications.

To alleviate some of the problems, some prior art clamps have used a ball and socket type of joint connecting the fixed jaw to the clamp body. These prior art devices have suffered significant disadvantages in operation. They have not alleviated the adverse effects of the torque that is applied to the opposing jaw. Prior art ball and socket type joints are also difficult to assemble and replace.

SUMMARY OF THE INVENTION

It is a principal object of the present invention to provide an improved lifting clamp.

Further, an important object of this invention is to provide an improved clamp that can maintain a secure grip on a member being lifted with the clamp.

Another object of the invention is to provide a clamp that employs an improved ball and socket configuration to uniformly distribute the lifting load within the socket.

A further object of the invention is to provide an improved clamp whereby both gripping surfaces of the clamp will stay substantially parallel to the surface of the member being lifted.

A still further object of the invention is to provide an improved ball and socket configuration that is simple to assemble and replace.

The clamp of the present invention is formed of a generally U-shaped body, with two material gripping surfaces attached to opposing portions of the body, such that a material receiving slot is created between the gripping surfaces. The distance between the gripping surfaces is adjustable such that a member placed between the surfaces can be gripped by reducing the distance between the surfaces. At least one of the gripping surfaces is attached to the clamp body by means of a pivotally mounted jaw. The jaw is mounted with an improved ball and socket configuration such that the jaw is movable with a member being gripped to enable the gripping surface of the jaw to remain substantially parallel with the surface of the member while evenly distributing the load within the socket. The load is evenly distributed along a line contact between an intermediate portion of the jaw and an opposed tapered portion of the clamp body. The improved jaw configuration of the present invention can be utilized with any standard clamp, including screw-type clamps and clamps utilizing a caming jaw. The ball in the ball and socket joint contains an annular groove and is held into the socket by a plurality of pins that tangentially engage the groove thus allowing the jaw to be easily inserted and removed for replacement.

BRIEF DESCRIPTION OF THE DRAWINGS

The foregoing objects, as well as others, will become apparent through consideration of the following detailed description of the invention given in connection with the accompanying illustrations on the drawings in which.

DETAILED DESCRIPTION OF THE PREFERRED EMBODIMENTS

Various embodiments of the clamp according to the present invention will now be discussed. The following embodiments are for illustrative purposes only, and the improved jaw structure of the present invention may be utilized with any standard clamp.

Figure 1:
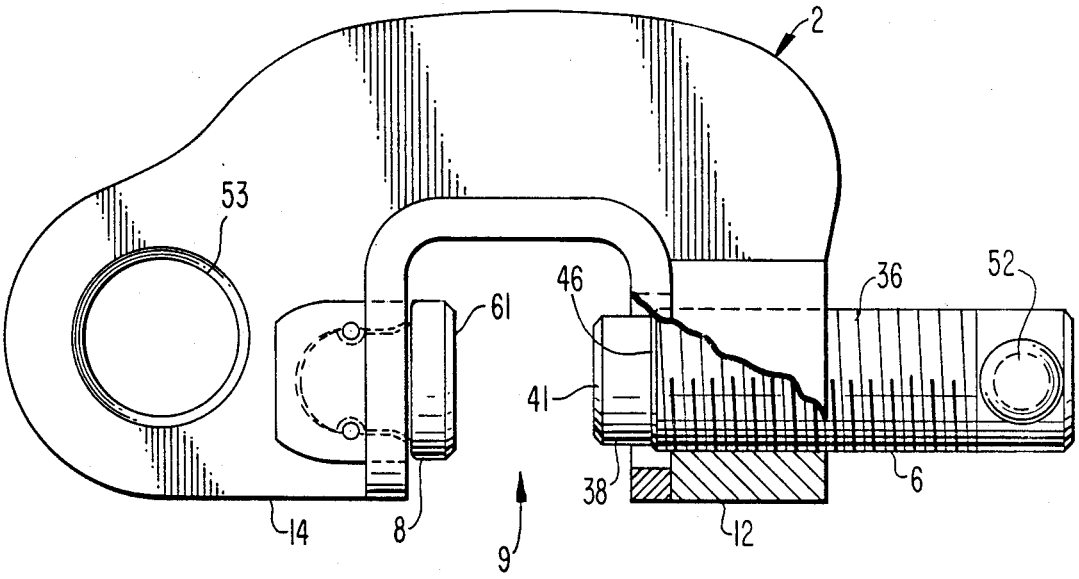
FIG. 1 is a side view showing a first embodiment of a screw-type clamp of the present invention.

In the embodiment of FIG. 1, the basic components of the clamp include the generally U-shaped clamp body 2, a screw 6 threadedly received through a portion of the body 2 and a jaw 8 pivotally mounted to the body 2 opposing the screw 6.

Figure 2:
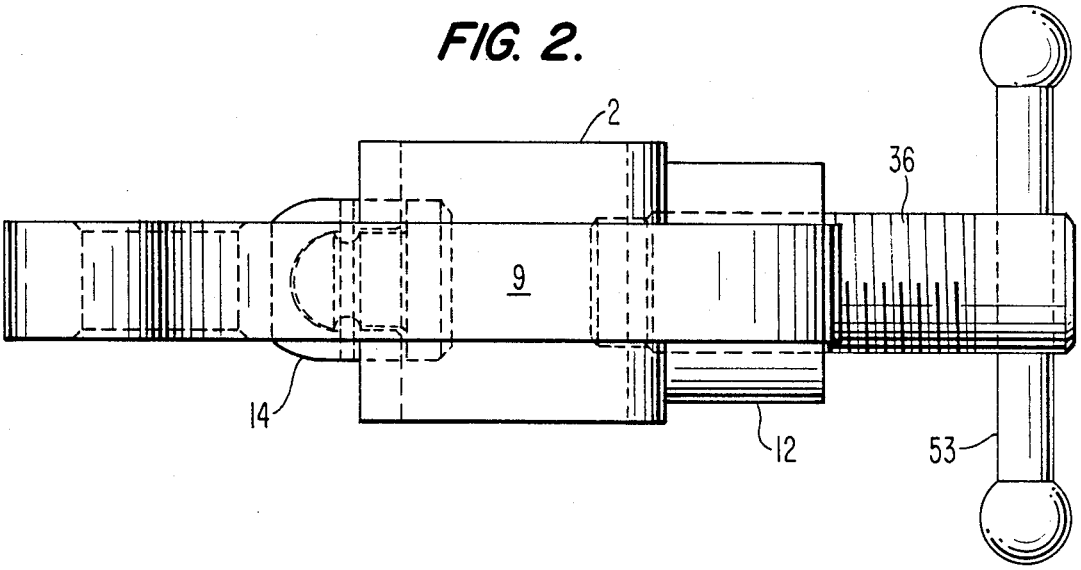
FIG. 2 is a top view of the clamp of FIG. 1.

The clamp body 2 may be fabricated of a generally U-shaped plate member defining a first projection 12 and a second projection 14 which, in turn, define a generally vertically downwardly facing slot 9 therebetween. First projection 12 is bored and internally threaded to threadedly receive screw 6 horizontally therethrough. Screw 6 comprises a threaded shaft 36 having a screw jaw 38 attached to the innermost end 46 of shaft 36 and fixed against vertical movement. The axially innermost portion of jaw 38 includes a material gripping surface 41 which opposes a gripping surface 61 on jaw 8 such that a structural member such as a steel plate can be received within the slot 9 and by advancing the screw 6, the member is securely gripped between the two gripping surfaces 41 and 61. The member may then be pulled by use of a shackle attached to the bore 53 or vertically lifted by use of bore 54 (shown in FIG. 3). FIG. 2 shows a top view of the clamp of FIG. 1.

Figure 3:
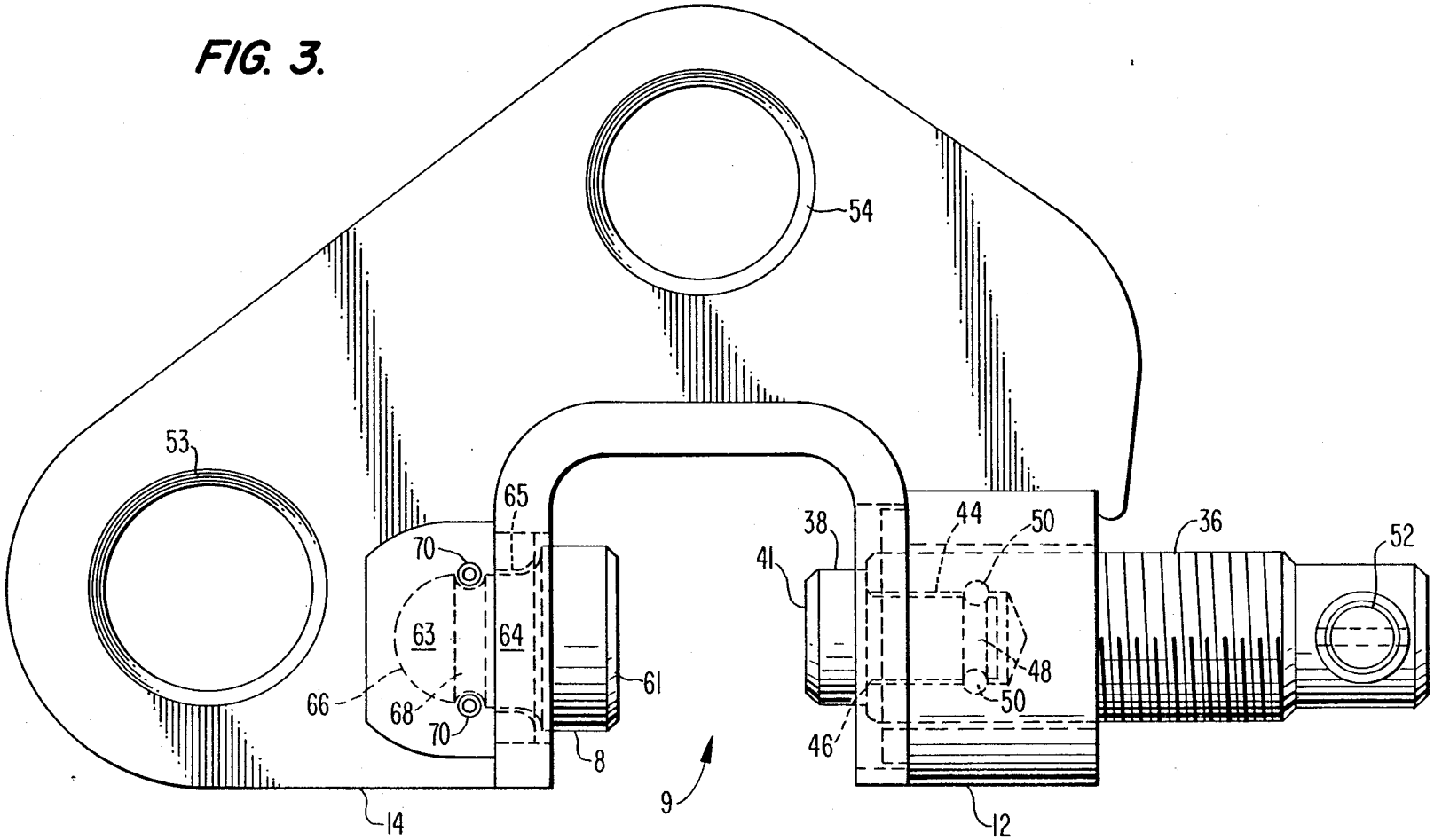
FIG. 3 is a more detailed view of the clamp of FIG. 1.

The clamp is shown in greater detail in FIG. 3. The portion of the jaw 38 axially opposite the material gripping surface includes a section of reduced diameter 42 which is rotatably received within a bore 44 extending inwardly of the innermost end 46 of the shaft 36. Adjacent the end of portion 42 axially remote from the gripping surface is an annular groove 48. A pair of spiral pins 50 are threaded through the shaft 36 and lie tangentially adjacent the groove 48 to restrain axial movement of the jaw 38 while permitting it to rotate or swivel about its axis. Thus, when the screw 6 is advanced to bring material gripping surface 41 into a gripping relationship with the member in the slot, the jaw 38 may non-rotatably grip the member while the threaded shaft 36 continues to be threaded towards such member.

At the end of the shaft 36 opposite the jaw 38 there conveniently may be provided a bore 52 extending diammetrically through the shaft 36 to receive a rod 53 (shown in FIG. 2) or other tool to facilitate rotation of the shaft 36 by increasing the mechanical advantage of the user.

Figure 4:
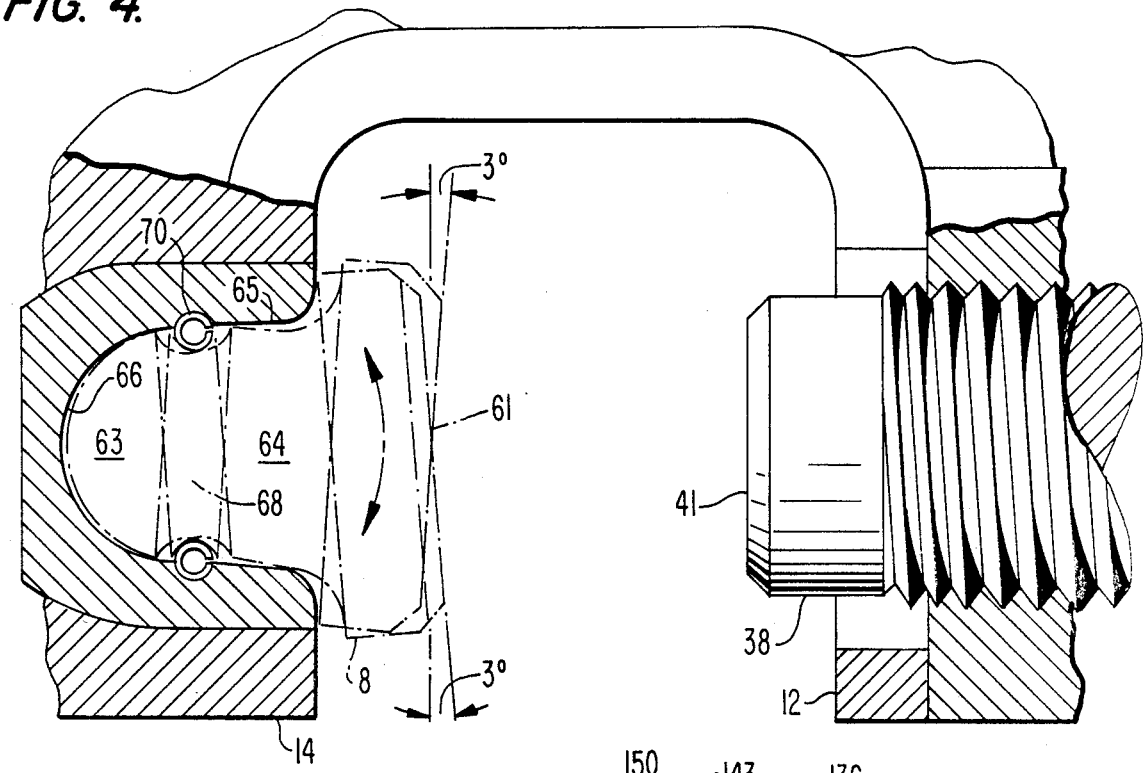
FIG. 4 is an enlarged partial view of the clamp of FIG. 3.

As shown in FIG. 3, the jaw 8 includes an outer end defining a material gripping surface 61 somewhat larger in diameter than that of surface 41. Axially opposite the outer end of jaw 8 is an inner end defining a section 63 of reduced diameter. Section 63 has a spherical or ball configuration which fits within a socket 65 having a spherical base 66. Running along the perimeter of section 63 is an annular groove 68. Spiral pins 70 are threaded through projection 14 and lie tangentially adjacent the groove 68 in a manner similar to the engagement of the spiral pins 50. Pins 70, however, are smaller in radius than the groove 68 and thus loosely engage the groove which permits the jaw 8 to be pivotally movable in all directions. As can be seen in FIG. 4, the jaw can move radially through a small angle, preferably about 3°, in any direction. Between the outer and inner ends of jaw 8 is an intermediate cylindrical portion 64 which is received within the outer end of the socket 65. The outer end of socket 65 is tapered, i.e., flared outwardly, to define stop means that restricts the pivotal movement of the jaw 8. The outer end of cylindrical portion 64 is also tapered, flared outwardly, and will engage the tapered or outwardly flared section of socket 65 at a point of maximum pivotal rotation of jaw 8. The amount that the jaw can pivot will also depend upon the size of the groove 68 as well as the general configuration of the ball and socket joint.

Figure 5:
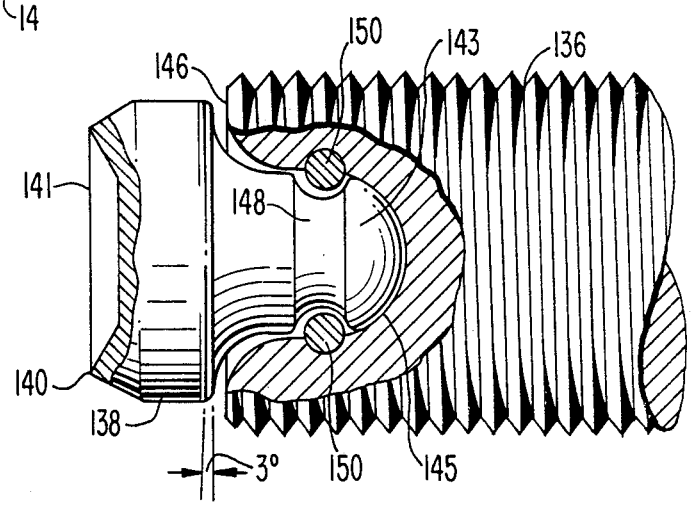
FIG. 5 is a partial view of a second embodiment of the invention.
Figure 6:
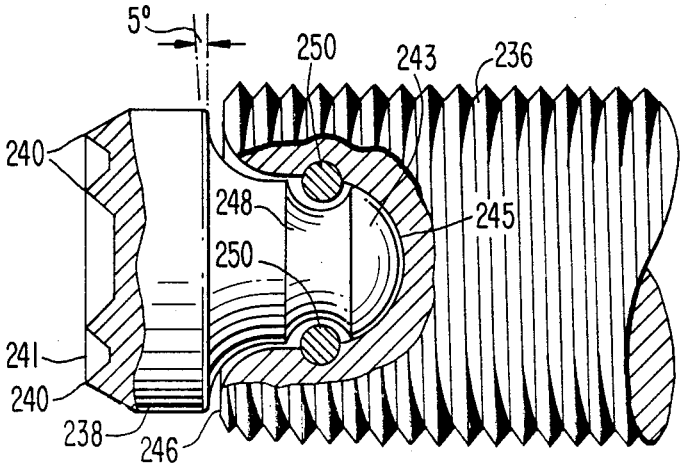
FIG. 6 is a partial view of a third embodiment of the invention.

Alternative embodiments of the invention are depicted in FIGS. 5 and 6. In these embodiments the jaws 138 and 238 that are attached to screws 136 and 236, respectively, are of a similar structure as jaw 8 and include sections of reduced diameter (143 and 243) that have a spherical or ball configuration, each of which fits within a spherical socket (145 or 245) extending inwardly. Balls 143 and 243 each include an annular groove 148 or 248. Pins 150 and 250 are threaded through shafts 136 and 236, respectively, and engage appropriate grooves 148 or 248 in the same manner that pins 70 engage groove 68. The jaw 138 depicted in FIG. 5 is pivotable through a small angle, preferably about 3°, in any direction. The outwardly flared intermediate portion of the jaw (138, 238) engages the outwardly flared outer portion of the socket (145, 245) which serves as stop means to limit the jaw rotation. As previously described, the degree of freedom of the jaw depends on various parameters. FIG. 6 depicts an embodiment wherein groove 248 is wider than groove 148 thus allowing the jaw to pivot up to 5° in any direction. By constructing the clamp with two jaws that are pivotal in this manner both gripping surfaces can assume a position parallel to and in full engagement with the structural member being gripped. When the gripped member swings about, the gripping surfaces move with the member and remain substantially parallel to the respective surfaces which they grip.

Each gripping surface (41, 141, 241) of the screw shaft as shown in FIGS. 4, 5 and 6 comprises a set of vertically spaced teeth, the teeth preferably being in the form of sharp circular ridges which are concentric with the screw shaft. The gripping surface may be defined by a single circular ridge 140 or a plurality of concentric circular ridges 240. Gripping surface 61 can be of similar circular tooth construction to gripping surface 41 (or 141 or 241). Each of the gripping surfaces 61, 41, 141 or 241 thus can comprise a single circular ridge or a plurality of such ridges coaxial with each other. In each case, the gripping surface comprises gripping teeth, all of which lie in a common plane so that all of the teeth fully engage the respective flat surface of the structural member being gripped. Instead of circular gripping teeth, other conventional co-planar gripping surfaces may be used.

Gripping surface 61 is made larger in diameter than its opposing surface 41 (or 141 or 241) and the outer edge of surface 61 will always remain radially outside of surface 41 (or one of alternative surfaces 141 or 241). In other words, referring to FIG. 4, the radially outer edge of surface 61 will always be vertically higher and lower than any portion of surface 41 even when the jaw 64 is rotated upwardly or downwardly to its maximum limit.

When it is desired to grip structural members, such as a steel plate, I beam, angle or the like, by the clamp described above, the manner of operation and use is generally as follows: The edge of the plate is introduced into slot 9 and is positioned between screw jaw 38 and pivotable jaw 8, which is axially aligned with the screw 6. Then, by hand or by means of rod 53 or other tool inserted through the bore 52 in the outer end of threaded shaft 36, screw 6 is threadedly advanced forcing the steel plate into a gripping relationship between the gripping surface 61 of pivotable jaw 8 and the gripping surface 41 of screw jaw 38. The screw 6 need only be firmly hand tightened. When a lifting force is applied to the clamp in either a vertical or a horizontal direction, the plate being lifted may swing about and the pivotable jaw 8 can move with the swinging plate with the gripping surface 61 substantially parallel to and in full gripping engagement with the flat surface of the plate, thus preventing the plate from slipping out of the clamp. When a pivotable jaw is used for the screw jaw as shown in FIGS. 5 and 6, both opposed clamp jaws can move with the plate with their gripping surfaces substantially parallel to the respective gripped surfaces of the member being lifted, thus providing a secure grip on the member. By providing an even and secure grip on the material being lifted, the load will be evenly distributed.

Figure 9:
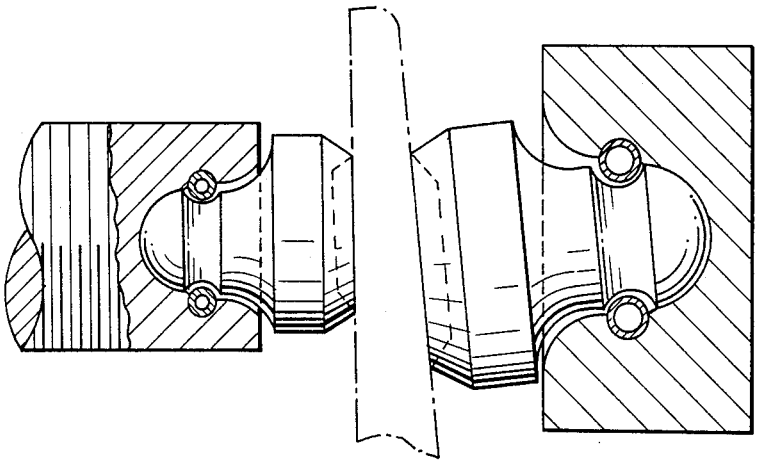
FIG. 9 shows a member being gripped by two pivotal jaws of the present invention.

When a clamp with a pivoted screw jaw, as shown in FIGS. 5 and 6, is used to grip a structural member having flat, parallel opposite surfaces such as a steel plate, the opposed material gripping surfaces of the screw jaw (138 or 148) and the pivotable jaw 8 remain parallel to each other. Other structural members such as I beams, channels or the like may have opposite flat surfaces which, while substantailly parallel, are slightly tapered relative to each other. When gripping such members, the opposing material gripping surfaces of the clamp jaws assume a corresponding tapered relationship but individually are parallel to the respective surfaces which they grip. FIG. 9 depicts such a member being gripped.

Since, through continued use, one or both of the gripping surfaces may become worn, it may be desirable to replace jaw 8 or jaw 38. This can be easily accomplished through removal of the spiral pins, since the pins are the only means that holds the jaws in place.

Figure 7:
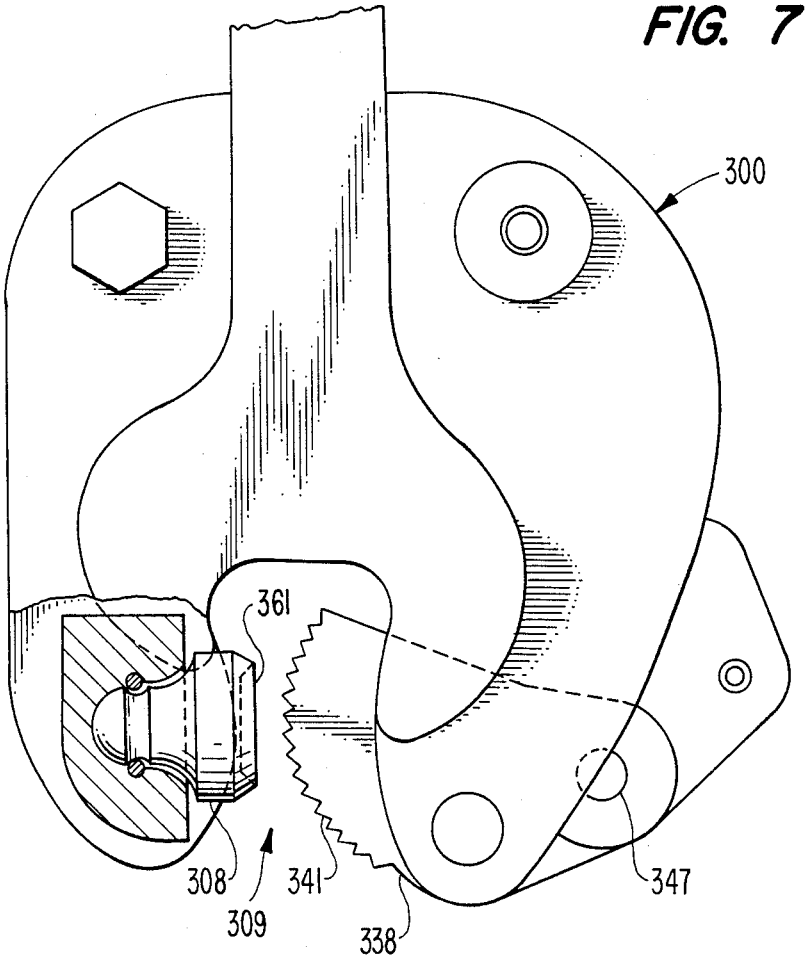
FIG. 7 is a side view showing a second embodiment of a clamp of the present invention.

FIG. 7 illustrates a second embodiment of a clamp according to the invention. The clamp is generally designated at 300 and comprises a pivotal jaw 308, and opposing gripping cam 338. A member to be gripped, such as a steel plate, can be received within slot 309. When the clamp is lifted vertically, gripping surface 361 of jaw 308 and gripping surface 341 of gripping cam 338 will engage the structural member. Since gripping cam 338 is rotatable around pin 347, and since the diameter of gripping cam 338 increases toward the top of the cam, gripping surface 341 will engage a structural member with increasing force as the clamp is lifted vertically. The gripping surface 361 of swivel jaw 308 will remain parallel to the structural member being gripped. In this way, pivotal movement of the structural member is allowed while keeping the entire gripping surface 361 in contact with the member.

Figure 8:
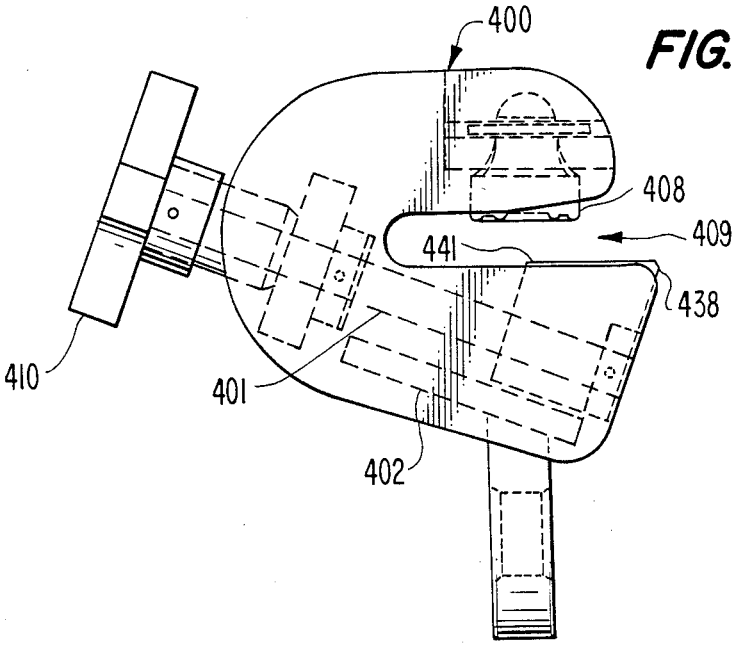
FIG. 8 is a side view showing a third embodiment of a clamp of the present invention.
Figure 10:
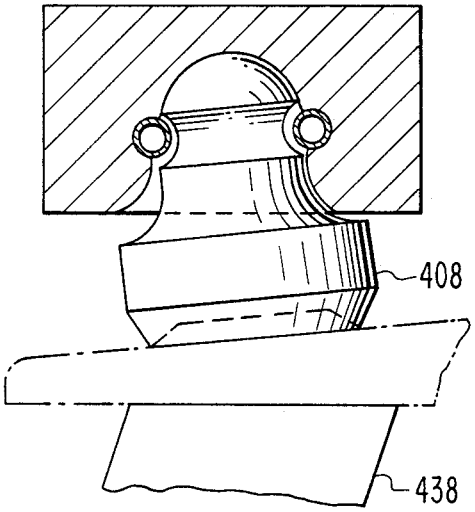
FIG. 10 shows a member being gripped by the clamp of FIG. 8.
Figure 14:
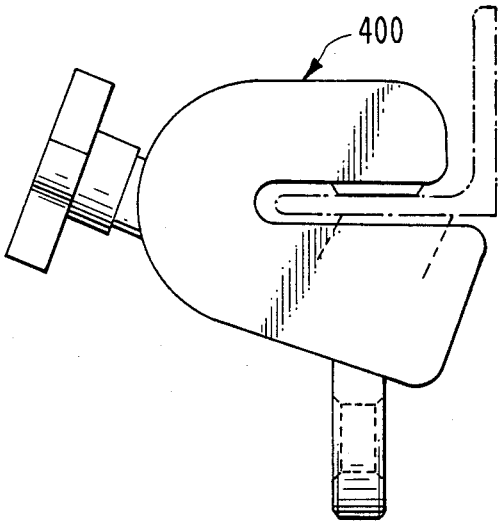
FIG. 14 is a side view of the jaw of FIG. 8 gripping a structural member.
Figure 15:
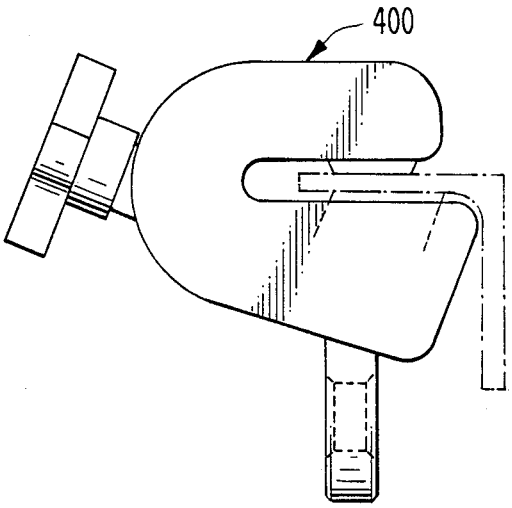
FIG. 15 is a side view of the clamp of FIG. 8 gripping a structural member.

Another embodiment of the clamp according to the present invention is illustrated in FIG. 8. The clamp is illustrated generally at 400 and includes a material receiving slot 409, a pivotal jaw 408, and opposing jaw 438. A structural member to be gripped is inserted into material receiving slot 409, and jaw 438 is adjusted to grip the structural member by means of adjusting screw 401 and plate 402. Adjusting screw 401 is controlled by handle 410. When handle 410 is turned counter-clockwise jaw 438 moves toward handle 410. Since jaw 438 contacts plate 402, gripping surface 441 moves toward jaw 408 as jaw 438 moves toward handle 410. FIG. 10 shows an enlarged view of a structural member being gripped in slot 409 of jaw 400. FIGS. 14 and 15 also depict clamp 400 gripping structural members. It may also be desirable to modify jaw 438 to include a pivotal jaw similar to jaw 408.

Figure 11:
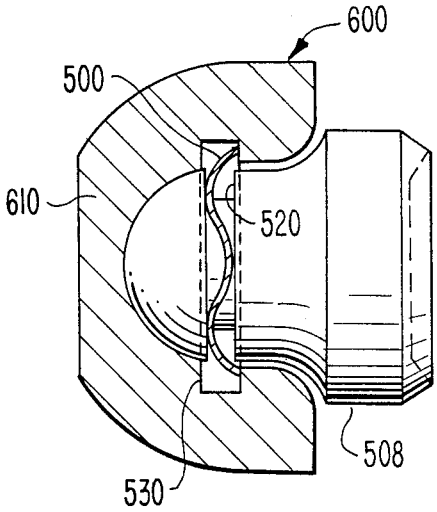
FIG. 11 is a side view of an alternative embodiment of the swivel jaw of the present invention.
Figure 12:
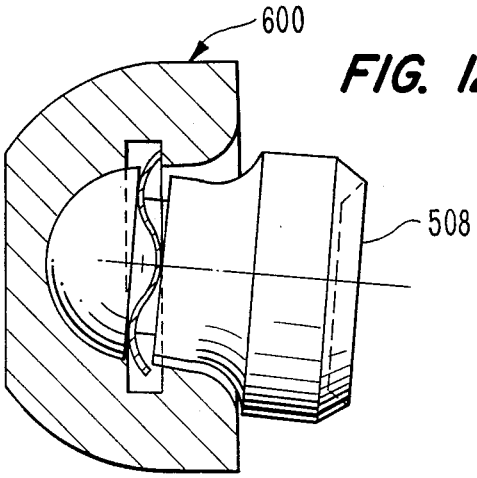
FIG. 12 is a side view of the swivel jaw of FIG. 11 under load conditions.
Figure 13:
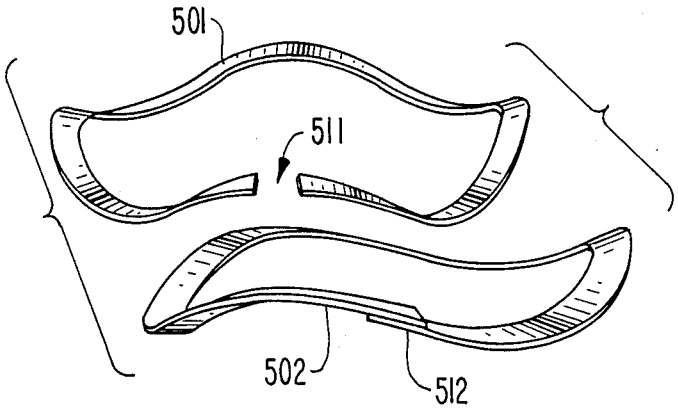
FIG. 13 is a view of two alternative wave springs usable with the jaw of the present invention.

Another embodiment of the pivotal jaw is shown in FIG. 11 and is illustrated generally at 600. The jaw of FIG. 11 uses a wave spring 500 in place of spiral pins, such as pins 70, shown in FIG. 3. Wave spring 500 is inserted into annular groove 520 of jaw 508 and fits into annular groove 530 formed in the clamp body 610. The use of a wave spring has the advantage that a force is applied to the jaw which keeps the jaw centered in the socket when no load is applied. With the jaw centered in the socket, it will be easier to grip structural members since the gripping surface of the jaw will be parallel to the structural member before a gripping force is applied. As the gripping force is applied, wave spring 500 may be compressed. FIG. 12 shows the jaw of FIG. 11 under load conditions. FIG. 13 shows two alternative embodiments of wave spring 500. Spring 501 contains a gap 511, and spring 502 overlaps itself at point 512. The wave spring may be replaced by any appropriate spring.

In addition to the gripping advantages achieved by the present invention in keeping the gripping surfaces parallel to and in full gripping engagement with the material being gripped, the improved jaw and socket combination results in a substantially improved distribution of the load. As can be clearly seen in FIGS. 4, 9, and 12, there is a smooth line contact between the intermediate portion of the jaw and the corresponding tapered section of the bore when the jaw is under load conditions and is pivoted to its maximum point. This line contact is achieved by tapering the jaw and bore such that they each have the same longitudinal curvature over a substantial distance. In this manner the load is distributed evenly over a much larger area than is common in prior art ball and socket jaw combinations that apply the load to point contacts. This improved distribution of the load will result in extended life of the clamp, as well as improved performance and safer operation.

While preferred embodiments of the clamp of this invention have been described above in detail, this description is intended to be only illustrative and not limiting since numerous variations, all within the scope of this invention, may be made. Thus, the invention is to be limited only by the claims appended hereto.

I claim:

1. A lifting clamp for gripping materials comprising:

a clamp body adapted for connection to a lifting device and having spaced, opposed, first and second body projections defining therebetween a material receiving slot, said first body projection comprising a first material gripping surface and said second body projection comprising a second material gripping surface;

adjusting means for adjusting the distance between said first and second material gripping surfaces such that a structural member in said slot is urged into a gripping relationship between said gripping surfaces when the distance between said gripping surfaces is reduced to enable the structural member to be lifted by the clamp;

a jaw having an inner end mounted in said first body projection and an outer end defining said first material gripping surface, said first material gripping surface being engageable with a surface of a member in the slot, said first body projection and the inner end of said jaw defining a close fitting ball and socket connection therebetween to permit pivotal movement of the outer end of said jaw to enable said jaw to move with the member being gripped in said slot when the member swings while being lifted with said first material gripping surface substantially parallel to, and in full gripping engagement with, the surface of the swinging member; and wherein said jaw has an intermediate portion between said ball and socket connection and said first material gripping surface, and said first body projection defines a bore fixed relative to said first body projection with an outer portion of said bore surrounding and radially spaced from said intermediate jaw portion to permit said pivotal movement of the outer end of said jaw and to limit said pivotal movement by engagement between said intermediate jaw portion and said outer bore portion.

2. A clamp according to claim 1 wherein said outer bore portion and said intermediate jaw portion are flared outwardly such that said intermediate jaw portion engages said outer bore portion at a point of maximum pivotal movement of said jaw.

3. A clamp according to claim 1 wherein said intermediate jaw portion and said outer bore portion are flared with matching curvatures such that elongated mating contact is formed when said outer bore portion engages said intermediate jaw portion.

4. A clamp according to claim 1 wherein said first material gripping surface comprises a flat plane.

5. A clamp according to claim 4 wherein said surface of the member is a flat surface.

6. A clamp according to claim 1 wherein said ball in said ball and socket connection has an annular groove running along its outer perimeter, said ball being held into said socket by a plurality of pins that run through said first body projection and loosely fit into said annular groove.

7. A clamp according to claim 1 wherein said ball in said ball and socket connection has a first annular groove running along its outer perimeter, said socket has a second annular groove corresponding to said first annular groove and wherein said ball is held into said socket by a spring that engages said first and second annular grooves to thereby center said jaw in said socket when no load is applied.

8. A clamp according to claim 1 wherein said second body projection comprises a second jaw.

9. A clamp according to claim 8 wherein said second jaw comprises said second material gripping surface and a back cylindrical projection, said cylindrical projection being received within a socket in said second body projection, said cylindrical projection having an annular groove running vertically along its outer perimeter and said second jaw being held into said socket by a plurality of pins running through said second body projection and loosely fitting into said annular groove of said cylindrical projection to allow said second jaw to be rotationally movable.

10. A clamp according to claim 9 wherein said plurality of pins tangentially engage said annular groove.

11. A clamp according to claim 1 wherein said second body projection comprises a second jaw having an inner end mounted in said second body projection end an outer and defining said second material gripping surface, said second material gripping surface being engagable with a second surface of a member in the slot, said second body projection and said inner end of said second jaw defining a second ball and socket connection therebetween to permit pivotal movement of the outer end of said second jaw to enable said second jaw to move with the member being gripped in said slot with said second material gripping surface substantially parallel to, and in full gripping engagement with, the second surface of the member.

12. A clamp according to claim 11 wherein said ball in said second ball and socket connection has an annular groove running along its outer perimeter, said ball being held into said socket by a plurality of pins that run through said second body projection and loosely fit into said annular groove.

13. A clamp according to claim 11 wherein said second material gripping surface is a flat plane.

14. A clamp according to claim 1 wherein said second surface of the member is a flat surface.

15. A clamp according to claim 11 wherein said second jaw has a second intermediate portion between said second ball and socket connection and said second material gripping surface, and said second body projection defines a second bore fixed relative to said second body projection with an outer portion surrounding and radially spaced from said second intermediate jaw portion to permit said pivotal movement of the outer end of said second jaw and to limit said pivotal movement by engagement between said intermediate second jaw portion and said second outer bore portion.

16. A clamp according to claim 15 wherein said outer portion of said second bore and said second intermediate jaw portion are outwardly flared such that said second intermediate jaw portion engages said outer bore portion of said second bore at a point of maximum pivotal movement of said second jaw.

17. A clamp according to claim 1 wherein said first and said second gripping surfaces are circular and said first gripping surface is radially larger than said second gripping surface.

18. A clamp according to claim 15 wherein said second intermediate jaw portion and said outer bore portion of said second bore are outwardly flared such that a line contact is formed when said outer bore portion of said second bore engages said second intermediate jaw portion.

19. A clamp according to claim 1 wherein said jaw is pivotable up to 3°.

20. A clamp according to claim 11 wherein said second jaw is pivotable up to 5°.

21. A clamp according to claim 7 wherein said spring is a wave spring.

22. A screw-type lifting clamp for gripping materials comprising:

a clamp body adapted for connection to a lifting device and having spaced, opposed, first and second body projections defining therebetween a material receiving slot, said first body projection comprising a first material gripping surface and said second body projection comprising a second material gripping surface;

a screw having a shaft threadedly received through said first body projection for rotation about a horizontal axis, said screw having a first end defining said first material gripping surface and extending into said slot toward said second body projection, said screw being threadedly movable horizontally toward and away from said second body projection;

a jaw having an inner end mounted in said second body projection and an outer end defining said second material gripping surface so that threaded movement of said screw toward said jaw urges a structural member in said slot into a gripping relationship between the first and second material gripping surfaces to enable the structural member to be lifted by the clamp, said second projection and said inner end of said jaw defining a ball and socket connection therebetween to permit pivotable rotation of the outer end of said jaw to enable said jaw to move with the member being gripped in said slot when the member swings while being lifted with said second material gripping surface substantially parallel to and in full gripping engagement with a surface of the swinging structural member; and wherein said jaw has an intermediate portion between said ball and socket connection and said first material gripping surface, and said second projection defines a bore fixed relative to said second body projection with an outer of said bore portion surrounding and radially spaced from said intermediate jaw portion to permit said pivotal movement of the outer end of said jaw and to limit said pivotal movement by engagement between said intermediate jaw portion and said outer bore portion.

23. A screw-type clamp according to claim 22 wherein said outer bore portion and said intermediate jaw portion are flared outwardly such that said intermediate jaw portion engages said outer bore portion at a point of maximum pivotal movement of said jaw.

24. A screw-type clamp according to claim 22 wherein said intermediate jaw portion and said outer bore portion are flared with matching curvatures such that elongated mating contact is formed when said outer bore portion engages said intermediate jaw portion.

25. A screw-type clamp according to claim 22 wherein said ball in said ball and socket connection has an annular groove running along its outer perimeter, said ball being held into said socket by a plurality of pins that run through said second body projection and loosely fit into said annular groove.

26. A screw-type clamp according to claim 22 wherein said ball in said ball and socket connection has a first annular grove running along its outer perimeter, said socket has a second annular grove corresponding to said first annular groove, and wherein said ball is held into said socket by a spring that engages said first and second annular grooves to thereby center said jaw in said socket when no load is applied.

27. A screw-type clamp according to claim 26 wherein said spring is a wave spring.

28. A screw-type clamp according to claim 22 further comprising a second jaw.

29. A screw-type clamp according to claim 28 wherein said second jaw comprises said first material gripping surface and a back cylindrical projection, said cylindrical projection being received within a socket in said screw, said cylindrical projection having an annular grove running vertically along its outer perimeter and said second jaw being held into said socket by a plurality of pins running through said screw and loosely fitting into said annular grove of said cylindrical projection to allow said second jaw to be rotationally moveable.

30. A screw-type clamp according to claim 22 further comprising a second jaw having an inner end mounted in said screw and an outer end defining said first material gripping surface, said first material gripping surface being engagable with a second surface of the member in the slot, said screw and said inner end of said second jaw defining a second ball and socket connection therebetween to permit pivotable movement of the outer end of said second jaw to enable said second jaw to move with the member being gripped in said slot with said first material gripping surface substantially parallel to and in full gripping engagement with the second surface of the member.

31. A screw-type clamp according to claim 30 wherein said ball in said second ball and socket connection has an annular grove running along its outer perimeter, said ball being held into said socket by a plurality of pins that run through said screw and loosely fit into said annular groove.

32. A screw-type clamp according to claim 30 wherein said second jaw has a second intermediate portion between said second ball and socket connection and said first material gripping surface, and said screw defines a second bore with an outer portion surrounding and radially spaced from said second intermediate jaw portion to limit said pivotable movement of said second jaw.

33. A screw-type clamp according to claim 32 wherein said outer portion of said second bore and said second intermediate jaw portion are flared outwardly such that said second intermediate jaw portioning engages said outer bore portion of said second bore at a point of maximum pivotable movement of said second jaw.

34. A screw-type clamp according to claim 33 wherein said second intermediate jaw portion and said outer bore portion of said bore are flared with matching curvatures such that elongated mating contact is formed when said outer bore portion of said second bore engages said second intermediate jaw portion.

35. A lifting clamp for gripping materials comprising:

a clamp body adapted for connection to a lifting device and having spaced, opposed, first and second body projections defining therebetween a material receiving slot, said first body projection comprising a first material gripping surface and said second body projection comprising a second material gripping surface;

a gripping cam attached to said first body projection and comprising said first material gripping surface, said first material gripping surface extending into said slot towards said second body projection;

a jaw having an inner end mounted in said second body projection and an outer end defining said second material gripping surface so that a structural member in said slot may be urged into a gripping relationship between said first and second material gripping surfaces to enable the structural member to be lifted by the clamp, said second body projection and the inner end of said jaw defining a ball and socket connection therebetween to permit pivotable rotation of the outer end of said jaw to enable said jaw to move with the member being gripped in said slot when the member swings while being lifted with said second material gripping surface substantially parallel to and in full gripping engagement with a surface of the swinging member; and wherein said jaw has an intermediate portion between said ball and socket connection and said first material gripping surface, and said second projection defines a bore fixed relative to said second body projection with an outer of said bore portion surrounding and radially spaced from said intermediate jaw portion to permit said pivotal movement of the outer end of said jaw and to limit said pivotal movement by engagement between said intermediate jaw portion and said outer bore portion.

36. A clamp according to claim 35 wherein said outer bore portion and said intermediate jaw portion are flared outwardly such that said intermediate jaw portion engages said out bore portion at a point of maximum pivotal movement of said jaw.

37. A clamp according to claim 35 wherein said intermediate jaw portion and said outer bore portion are flared with matching curvatures such that elongated mating contact is formed when said outer bore portion engages said intermediate jaw portion.

38. A clamp according to claim 35 wherein said ball in said ball and socket connection has a first annular groove running along its outer perimeter, said socket has a second annular grove corresponding to said first annular groove and wherein said ball is held into said socket by a spring that engages said first and second annular grooves to thereby center said jaw in said socket when no load is applied.

39. A clamp according to claim 35 wherein said jaw is pivotable up to 3°.

40. A lifting clamp for gripping materials comprising:

a clamp body adapted for connection to a lifting device and having spaced, opposed, first and second body projections defining therebetween a material receiving slot, said first body projection comprising a first material gripping surface and said second body projection comprising a second material gripping surface;

adjusting means for adjusting the distance between said first and second material gripping surfaces such that a structural member in said slot is urged into a gripping relationship between said gripping surfaces when the distance between said gripping surfaces is reduced to enable the structural member to be lifted by the clamp;

a jaw having an inner end mounted in said first body projection and an outer end defining said first material gripping surface, said first material gripping surface being engageable with a surface of a member in the slot, said first body projection and the inner end of said jaw defining a close fitting ball and socket connection therebetween to permit pivotal movement of the outer end of said jaw to enable said jaw to move with the member being gripped in said slot when the member swings while being lifted with said first material gripping surface substantially parallel to, and in full gripping engagement with, the surface of the swinging member; and wherein said jaw has an intermediate portion between said ball and socket connection and said first material gripping surface, and said first body projection defines a bore fixed relative to said first body projection with an outer portion of said bore surrounding and radially spaced from said intermediate jaw portion to permit said pivotal movement of the outer end of said jaw, said first body projection and said jaw defining mutually matching surfaces engageable with each other by elongated mating contact over a substantial length to limit said pivotal movement.

* * * * *